United States Patent [19]

Edeus

[11] 4,098,530

[45] Jul. 4, 1978

[54] SLIDING DOOR LATCH

[75] Inventor: James A. Edeus, Rock Falls, Ill.

[73] Assignee: National Manufacturing Co., Sterling, Ill.

[21] Appl. No.: 731,637

[22] Filed: Oct. 12, 1976

[51] Int. Cl.[2] ..... E05C 5/00; E05C 19/12

[52] U.S. Cl. ..... 292/113; 292/66; 292/DIG. 30; 292/DIG. 46

[58] Field of Search ..... 292/65, 66, 108, 111, 292/113, 114, DIG. 30, DIG. 46

[56] References Cited

U.S. PATENT DOCUMENTS

| | | | |
|---|---|---|---|
| 961,780 | 6/1910 | Lauzon | 292/113 |
| 1,965,931 | 7/1934 | Parker | 292/113 |
| 3,740,978 | 6/1973 | Smith | 70/100 |

*Primary Examiner*—Robert L. Wolfe

*Attorney, Agent, or Firm*—Edmond T. Patnaude

[57] ABSTRACT

A jamb latch for a sliding door utilizes a pivotally mounted operating arm which in one position is used to pull the door in tightly against the jamb and to latch the door in place and which in a second position extends across the edge of the door to hold it in an open position.

10 Claims, 5 Drawing Figures

SLIDING DOOR LATCH

The present invention relates in general to jamb latches for use with sliding doors, and it relates in particular to a new and improved jamb latch which may be used as a stop for holding a sliding door in a fully open position as well as for pulling the door tightly against the door jamb and for latching the door in a closed position.

BACKGROUND OF THE INVENTION

Sliding doors are commonly used on utility type buildings such, for example, as barns and other storage buildings. Ordinarily, such doors are slidably mounted on the exterior side of a building so that when fully open they lie along the side of the building adjacent to the door opening. When closed, these doors extend across the front of the door frame and are generally held in the closed position by suitable latching mechanisms. These doors are relatively large and when in the open position can be moved across the door opening by wind gusts unless door stops are positioned across the path of travel thereof.

Inasmuch as latches are always used in conjunction with these doors it would be desirable to provide a latch construction which functions both as a latch to latch the door in the closed position as well as to function as a door stop to hold the door in the open position.

SUMMARY OF THE INVENTION

Briefly, in accordance with the present invention there is provided a new and improved latch construction which incorporates a pivotally mounted operating handle or lever arm which is used to latch a door to the door jamb and also to pull the door tightly against the door jamb to effect a suitable seal at the jamb edge of the door. The mounting plate to which this operating handle is pivotally mounted to the jamb includes a stop which is positioned to support the handle in an extended position across the path of travel of the door so that when the door is fully opened and the handle rests on the stop in the extended position, the handle functions as a door stop to prevent spurious or inadvertent movement of the door across the door opening.

GENERAL DESCRIPTION OF THE DRAWING

Further objects and advantages and a better understanding of the present invention can be had by reference to the following detailed description, wherein.

DETAILED DESCRIPTION OF THE INVENTION

Figure 1:
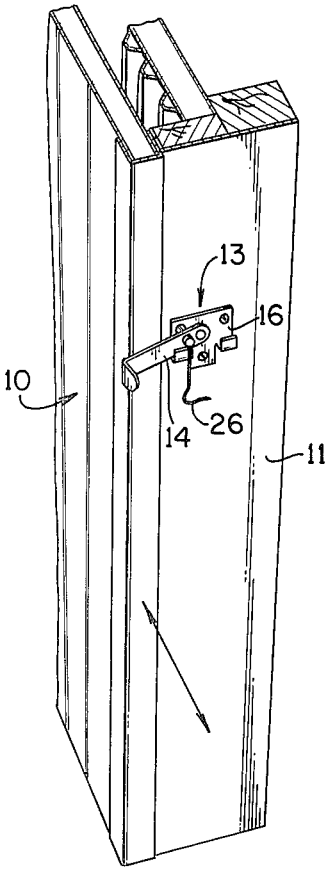
FIG. 1 is a fragmentary perspective view showing the jamb latch of the present invention in the door stop position holding a sliding door in the open position.

Referring to FIG. 1, a door 10 which is slidably mounted for movement in the direction of the arrows past a door jamb 11 is shown in the open position. The jamb 11 may include a wood pole which is embedded in the ground and provides one of the vertical structural members of the associated building. A latch 13 embodying the present invention and more fully described hereinafter in connection with FIGS. 2, 3, 4 and 5 is mounted to the door jamb 11 and includes an operating lever arm or handle 14. As shown in FIG. 1, the arm 14 is in the door stop position wherein it extends across the path of travel of the door 10. With the door 10 fully open and the operating arm 14 disposed across the forward edge thereof, as shown in FIG. 1, the door 10 cannot be moved across the door intercepting stop position. Suitable guide means not forming any part of the present invention are provided at the top and the bottom of the door 10 to hold it in place against the adjacent side of the building while the door is open.

Figure 2:
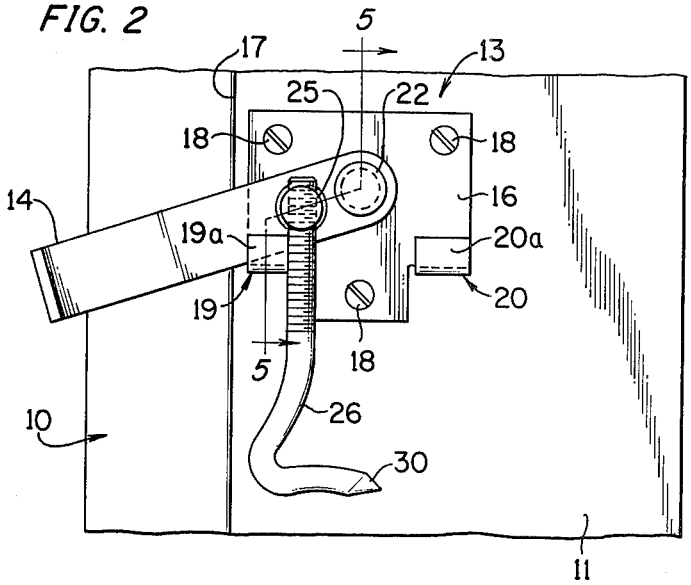
FIG. 2 is an elevational view showing the latch of the present invention in a door stop mode of operation.
Figure 3:
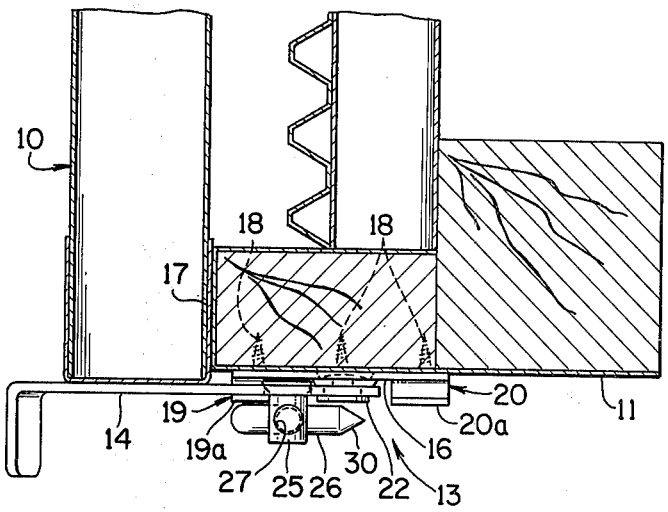
FIG. 3 is a top plan view of the latch of the present invention as shown in FIG. 2.

Referring to FIGS. 2 and 3, the latch 13 of the present invention may be seen to comprise a mounting or wear plate 16 which is attached to the jamb 11 near the outer edge 17 thereof by means of a plurality of screws 18 which extend through suitable holes in the plate 16. The bottom corner portions of the plate 16 are vertically slit and bent upwardly to provide a pair of integral L-shaped stops in the form of lugs 19 and 20. The upwardly extending flanges 19a and 20a at the distal ends of these stops are spaced from the plane of the outer face of the plate 16 by a distance slightly greater than the thickness of the operating arm 14 so that, as shown in FIGS. 2 and 3, the arm 14 may rest on the lugs between the outer face of the plate and the associated flanges.

Figure 5:
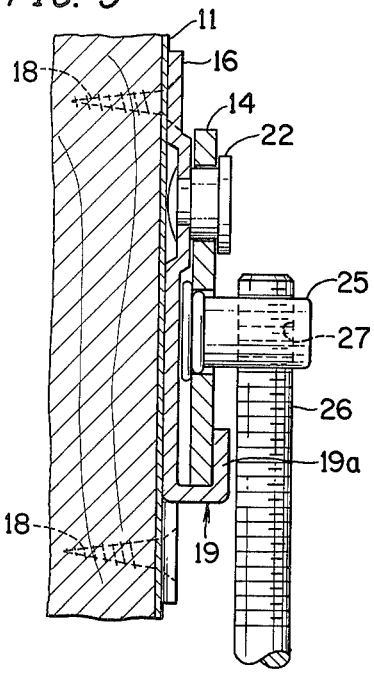
FIG. 5 is a cross-sectional view taken along the line 5—5 in FIG. 2 and showing the manner in which the handle is pivotally mounted to the mounting plate.

The operating arm 14 is journaled on a shaft 22 which is riveted to the plate 16, as best shown in FIG. 5, and which extends outwardly from the plate 16. The arm 14 is held in place on the shaft 22 by the enlarged head of the shaft 22. The axis of the shaft 22 is located a substantial distance above and midway between the lugs 19 and 20 whereby the weight of the arm 14 will hold it on one or the other of the lugs 19 and 20. The arm 14 is sufficiently long so that when resting on the forward stop member 19, it extends completely across the path of travel of the door 10 thereby to prevent spurious closing of the door.

Mounted to and extending outwardly from the arm 14 a short distance from the shaft 22 is a pivot rod 25 having a threaded transverse hole therein receiving the threaded end of a latch hook 26. The hole in the rod 25 which is identified at 27 in FIGS. 3 and 5 is spaced a short distance outwardly from the outer faces of the upstanding flanges 19a and 20a on the lugs 19 and 20 so that there is no interference by the lugs 19 and 20 with the hook 26.

Figure 4:
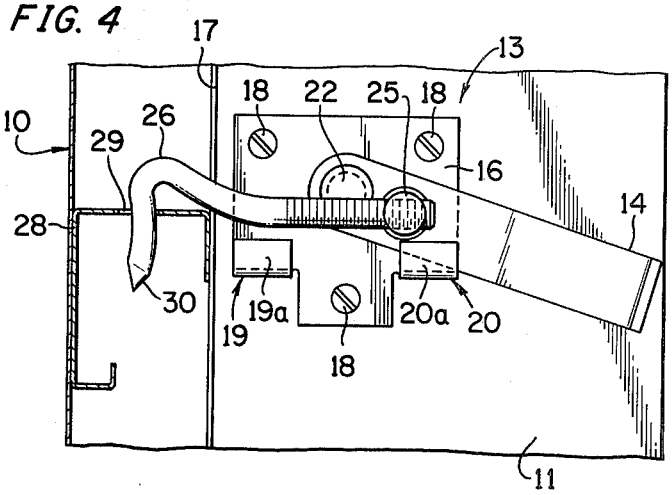
FIG. 4 is an elevational view similar to that of FIG. 2 but showing the latch of the present invention in a latching mode of operation.

In FIG. 4 the latch 13 is shown in a door latching position. The door 10 is illustrated in cross section and includes a horizontal frame piece in the form of a channel member 28 which is provided with a keeper hole 29 in the horizontal web portion thereof. The bill portion 30 of the hook 26 fits loosely into the opening 29 when the door is in the closed position and the arm is in an upstanding position. Thereafter, clockwise rotation of the arm 14 into the position shown in FIG. 4 pulls the hook 26 inward (to the right as shown in FIG. 4) to move the vertical edge of the door 10 tightly against the forward face of the jamb 11. When the operating arm 14 is in the illustrated latching position resting on the rear lug member 20, it may be seen that the axis of rotation of the hook 26 on the arm 14 is below the axis of rotation of the arm 14 on the mounting plate 16 whereby an outward pull on the door 10 cannot lift the arm 14 to release the hook but pulls the arm downwardly against the lug 20.

While the latch 13 is shown on the left-hand door jamb, it will be apparent to those skilled in the art that the latch 13 may be used on the right hand door jamb simply by rotating the hook 26 through an angle of 180° in the pivot rod 25. In that other position the arm 14 will rest on the lug 20 when in the stop position and will rest on the lug 19 when in the latching position.

There is thus provided in accordance with the present invention an inexpensive jamb latch for use with sliding doors. This latch provides the added function of holding the associated sliding door in an open position by utilizing the latch operating arm or handle as a door stop member. This novel latch construction may be used on both the left and right hand door jambs on double door closures, or it may be used on either or both jambs on single door closures.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A latch for use with a sliding door, comprising a mounting plate having means thereon for mounting said plate to a vertical door jamb with a first edge of said plate facing toward the path of said sliding door, an elongated arm mounted to said mounting plate for pivotal movement about a first axis extending perpendicularly to said plate, a pivot rod carried by said arm at a position displaced from said first axis, said rod extending parallel to said first axis, a hook mounted to said rod for free pivotal movement about the axis of said rod, a stop extending from said mounting plate between said first axis and said first edge across the path of movement of said arm for supporting said arm in an extended, substantially horizontal position across the path of said door, and said hook being freely movable past said stop.

2. A latch according to claim 1 wherein said stop comprises a stop member extending horizontally from said mounting plate, said stop member having an upwardly extending flange at the distal end thereof for engagement with the outer side of said arm.

3. A latch according to claim 2 wherein said stop member is an integral part of said plate.

4. A latch according to claim 1 comprising a second stop extending from said mounting plate across the path of movement of said arm, the axis about which said arm is pivotally mounted being located above and between said stops.

5. A latch according to claim 4 wherein said stops are integral with said plate, said stops being L-shaped lugs having upright flanges spaced from the outer face of said mounting plate by a distance greater than the thickness of said operating arm, whereby said arm may rest on said lugs between the outer face of said plate and said flanges.

6. In combination, a vertical door jamb, a door slidably movable past said jamb, a keeper on said door, a mounting plate secured to said jamb, an operating arm mounted on said mounting plate for pivotal movement in a plane transverse to the direction of movement of said door, said path of movement of said arm being partially across the path of movement of said door, a latch hook pivotably mounted to said arm for engagement with said keeper and a lug means extending from said plate across the path of movement of said arm for supporting said arm in a position across the path of movement of said door.

7. The combination according to claim 6 wherein said lug means is below the pivot axis of said arm.

8. The combination according to claim 7 wherein said lug means is L-shaped and has an upstanding flange at the distal end, said arm being disposed between said flange and the outer face of said mounting plate when resting on said lug.

9. The combination according to claim 6 comprising a second lug means extending from said plate across the path of movement of said arm for supporting said arm in a position extending away from the path of movement of said door, said second lug means being disposed below the pivot axis of said arm.

10. The combination according to claim 9 wherein each of said lug means has an upstanding flange at the distal end, and said arm being disposed between said flange and the outer face of said mounting plate when resting on the respective one of said lugs.

* * * * *